US006948777B2

(12) United States Patent
Marshall et al.

(10) Patent No.: US 6,948,777 B2
(45) Date of Patent: Sep. 27, 2005

(54) CHAIR WITH STORABLE OTTOMAN

(75) Inventors: Dale R. Marshall, Calgary (CA); Rupert Jakob-Bamberg, Calgary (CA)

(73) Assignee: Smed International, Calgary (CA)

( * ) Notice: Subject to any disclaimer, the term of this patent is extended or adjusted under 35 U.S.C. 154(b) by 0 days.

(21) Appl. No.: 10/238,945

(22) Filed: Sep. 10, 2002

(65) Prior Publication Data

US 2004/0046429 A1 Mar. 11, 2004

(51) Int. Cl.[7] ..... A47C 16/00

(52) U.S. Cl. ..... 297/423.4; 297/423.41; 297/423.2

(58) Field of Search ..... 297/423.42, 423.2, 297/423.21, 423.4, 423.41, 188.08, 188.11

(56) References Cited

U.S. PATENT DOCUMENTS 1,402,698 A * 1/1922 Weingarten ..... 297/423.2
1,879,673 A * 9/1932 Fischer ..... 297/423.4
2,247,720 A * 7/1941 Wonderly ..... 297/183.7
2,526,623 A * 10/1950 Maurer ..... 297/88
3,123,397 A * 3/1964 Murcott ..... 297/150
3,227,491 A * 1/1966 Conrad ..... 297/423.4
4,165,124 A * 8/1979 Olan ..... 312/235.6
5,120,071 A * 6/1992 Thibault et al. ..... 280/47.4
5,123,705 A * 6/1992 Johnson ..... 297/423.4
5,277,477 A * 1/1994 Sharff et al. ..... 297/423.21
5,520,436 A * 5/1996 Rader et al. ..... 297/188.11
6,074,000 A * 6/2000 Wagner ..... 297/188.11

* cited by examiner

*Primary Examiner*—Peter M. Cuomo
*Assistant Examiner*—Stephen D'Adamo
(74) *Attorney, Agent, or Firm*—Flynn, Thiel, Boutell & Tanis, P.C.

(57) ABSTRACT

A seating system is provided having a chair with a storage bay below the seat thereof and a cart-like ottoman which is storable within the storage bay. A connector arrangement is provided within the storage bay which positively engages the ottoman with the chair when the ottoman is rolled into the storage bay to a fully docked position. The chair and ottoman both include casters and the connector arrangement allows for both components to be moved simultaneously to a new position. In particular, preferably the chair includes casters on the front thereof and a handle on the back whereby lifting of the handle allows the chair as well as the docked cart to be tilted upwardly and rolled in unison to a new position.

13 Claims, 9 Drawing Sheets

CHAIR WITH STORABLE OTTOMAN

FIELD OF THE INVENTION

The invention relates to a seating system, and more particularly, to a seating system comprising a chair having a storage bay in which a mobile ottoman or cart is received.

BACKGROUND OF THE INVENTION

In open meeting areas, mobile chairs are often provided for participants in the meeting. By providing chairs which are mobile, the participants can readily move the chairs around into a different configuration most suitable for the type of meeting being held.

To further improve the comfort of the participants, separate ottomans or footstools may be provided which are associated with individual chairs and provide increased comfort, particularly for extended meetings. Additionally, such ottomans may be provided with storage areas for documents and the like.

It is an object of the invention to provide an improved seating system comprising a chair and ottoman-like stool which overcomes disadvantages associated with known chairs and stools.

The invention relates to a seating system comprising a chair and stool which are useable separately from each other but also connectable one within the other by a fixed connection or fastening to permit both components to be moved together in unison.

The chair is a mobile type chair having casters thereon. Preferably, a pair of casters are located on the front of the chair while support posts or legs are located on the back of the chair. When the casters and legs are disposed on the floor as occurs during use, the contact of the legs with the floor prevents undesirable shifting of the chair which might otherwise occur if four casters were provided on the chair bottom. The back of the chair includes a handle to facilitate repositioning of the chair within a space such as a meeting area. When a person grabs the handle and lifts the back of the chair, the weight of the chair is supported on the casters and allows for ready rolling of the chair to a new position. After repositioning, the person lowers the back of the chair to position the legs on the floor.

The chair further includes a storage bay located directly below the seat which storage bay includes an open front side that defines an entrance to the storage bay. The storage bay further opens downwardly toward the floor.

The mobile stool or cart has a box-like shape and includes multiple casters on the bottom surface thereof to support the weight of the stool and also allow the stool to be readily rolled to different locations. The stool fits within the storage bay by rolling same through the storage bay entrance.

A connector arrangement or fastening is provided within the storage bay to connect the stool to the chair when fully inserted within the storage bay and allow both components to be moved simultaneously together. In particular, the fastening engages the cart horizontally to resist removal of the cart from storage while also supporting the cart vertically during tilting of the chair. When the stool is engaged within the storage bay, lifting of the back end of the chair causes a simultaneous lifting of the back end of the stool so that the weight of the stool and the weight of the chair are supported by their respective front casters. The person thereby can move both components simultaneously to a new position. After the chair is repositioned and the chair and stool are lowered back to the floor, the stool may be removed or undocked merely by pulling the front of the stool which disengages same from the storage bay and separates the two components.

The connector arrangement provides for ready engagement and disengagement of the stool and chair and also allows for both components to be tilted and moved simultaneously together.

Other objects and purposes of the invention, and variations thereof, will be apparent upon reading the following specification and inspecting the accompanying drawings.

Figure 1:
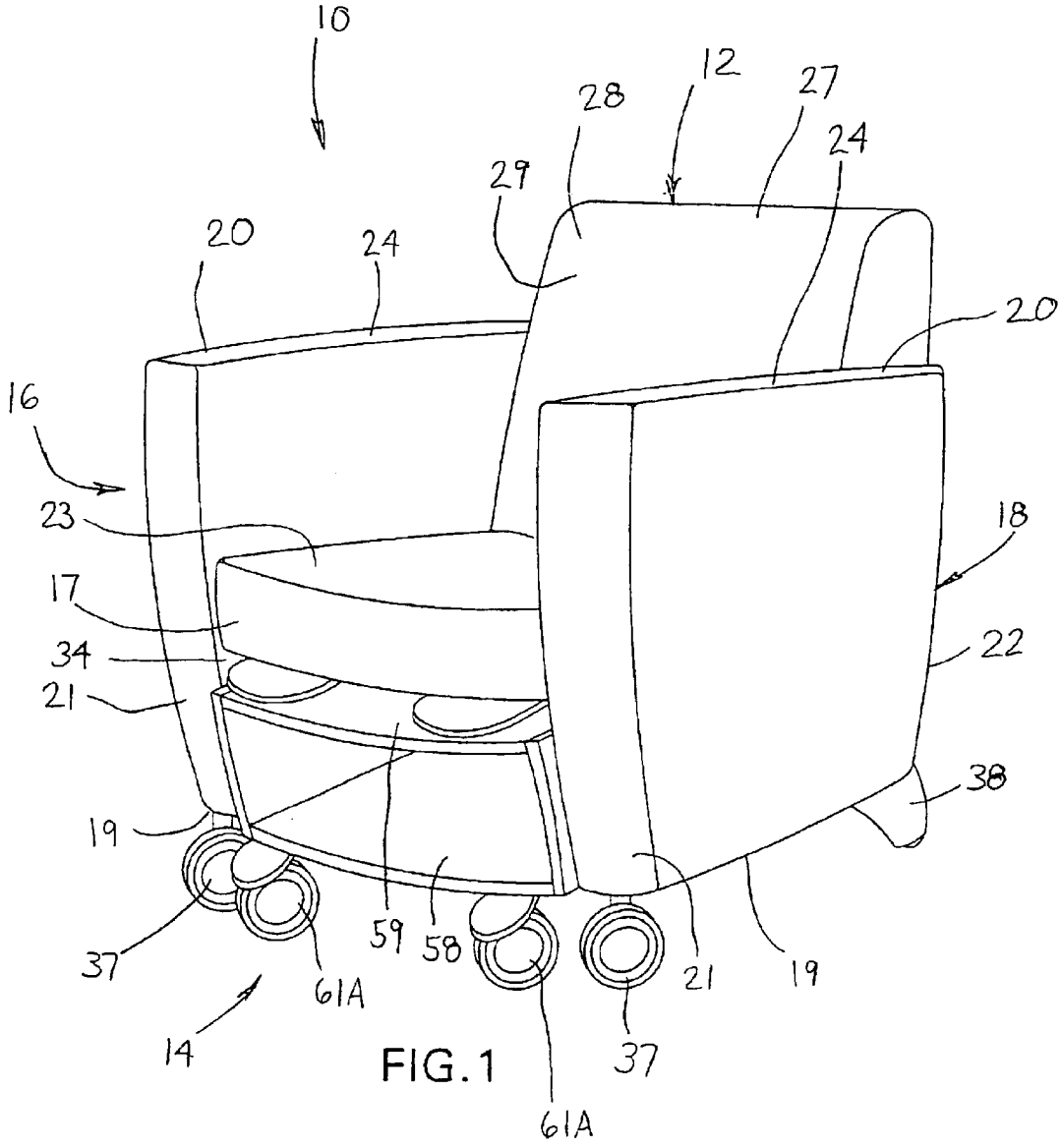
FIG. 1 is a perspective view of a seating system including a chair and a mobile stool stored therein in a storage bay.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
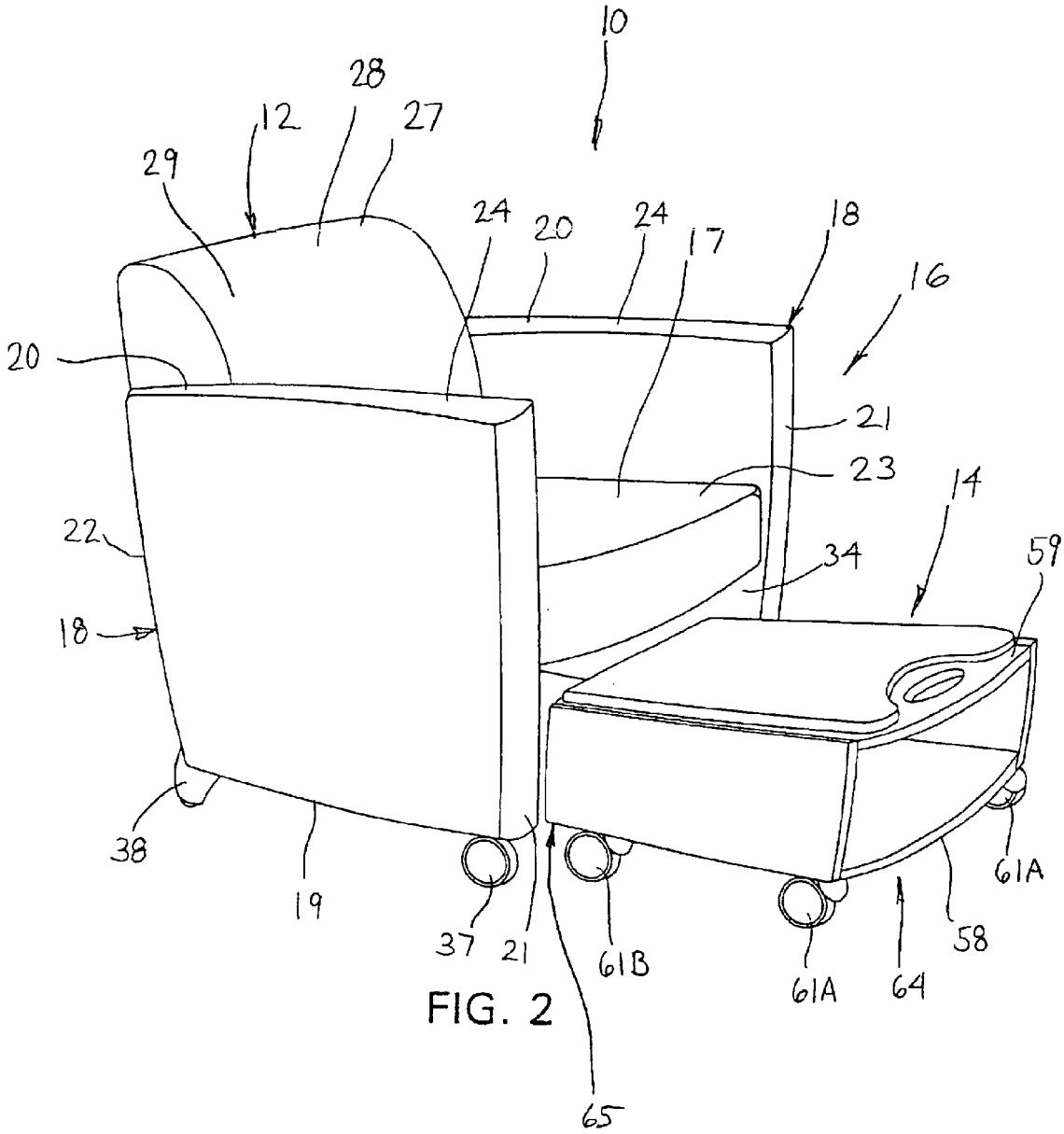
FIG. 2 is a perspective view illustrating the stool pulled out of the storage bay in a use position.

Referring to FIGS. 1 and 2, the invention relates to a seating system 10 which comprises a chair 12 and a mobile cart 14 which is storable within the chair 12 as illustrated in FIG. 1 and removable therefrom for use outside of the chair 12 as illustrated in FIG. 2.

The chair 12 generally has a support structure 16 on which is supported a cushioned seat 17. More particularly, the support structure 16 comprises a pair of generally rectangular side walls 18 which extend vertically from a bottom edge 19 to a top edge 20 and horizontally from a front edge 21 to a rear edge 22.

Figure 5:
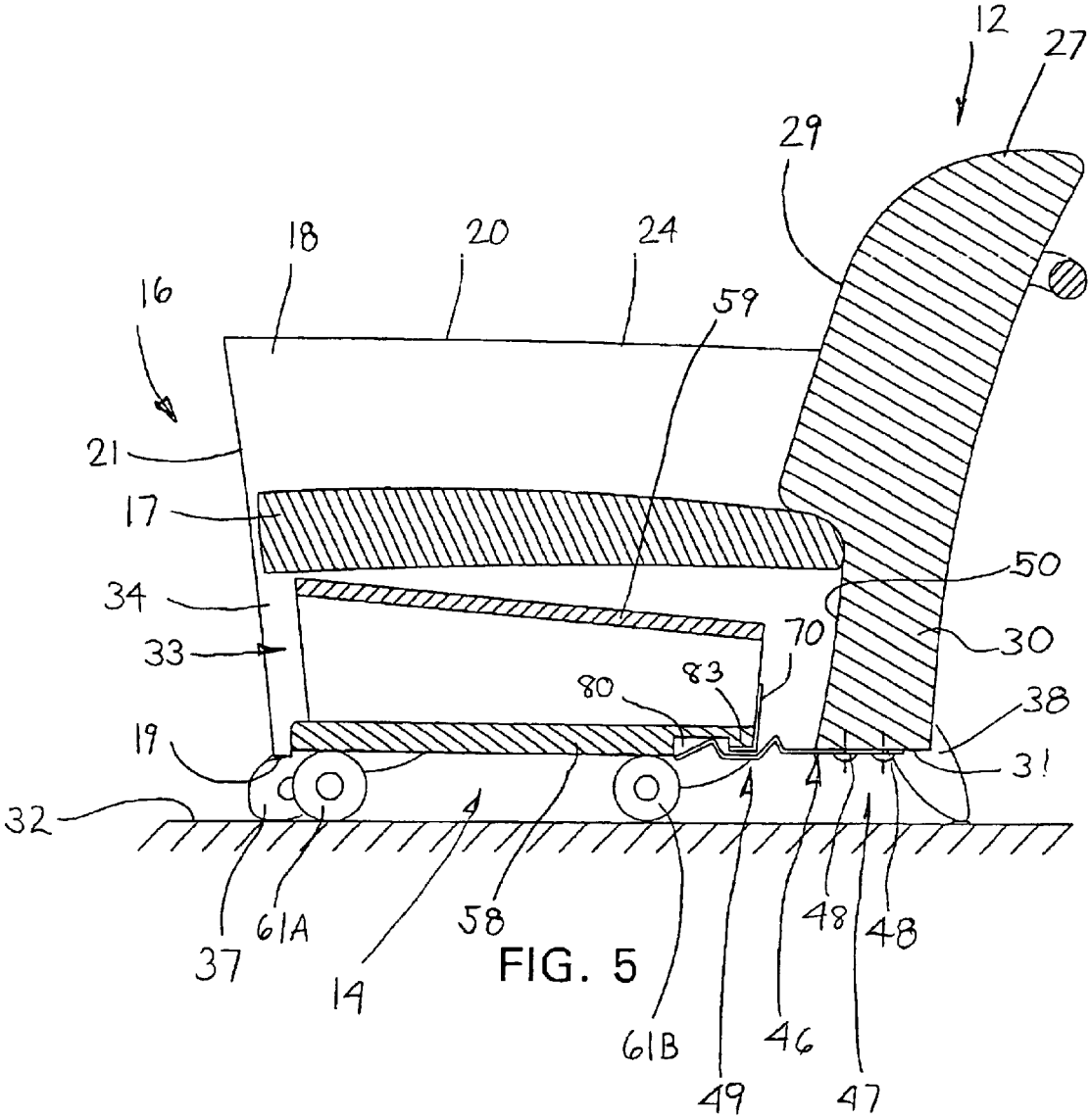
FIG. 5 is a side cross-sectional view of the chair and stool.

The side walls 18 are laterally spaced apart and support the seat 17 approximately halfway between the bottom and top edges 19 and 20 respectively. As such, the top side wall edge 20 is spaced vertically above the top surface 23 of the seat 17 as illustrated in FIG. 5. The top side wall edge 20 is formed relatively wide to effectively define an armrest 24 which is adapted to support the arms of a user.

Figure 3:
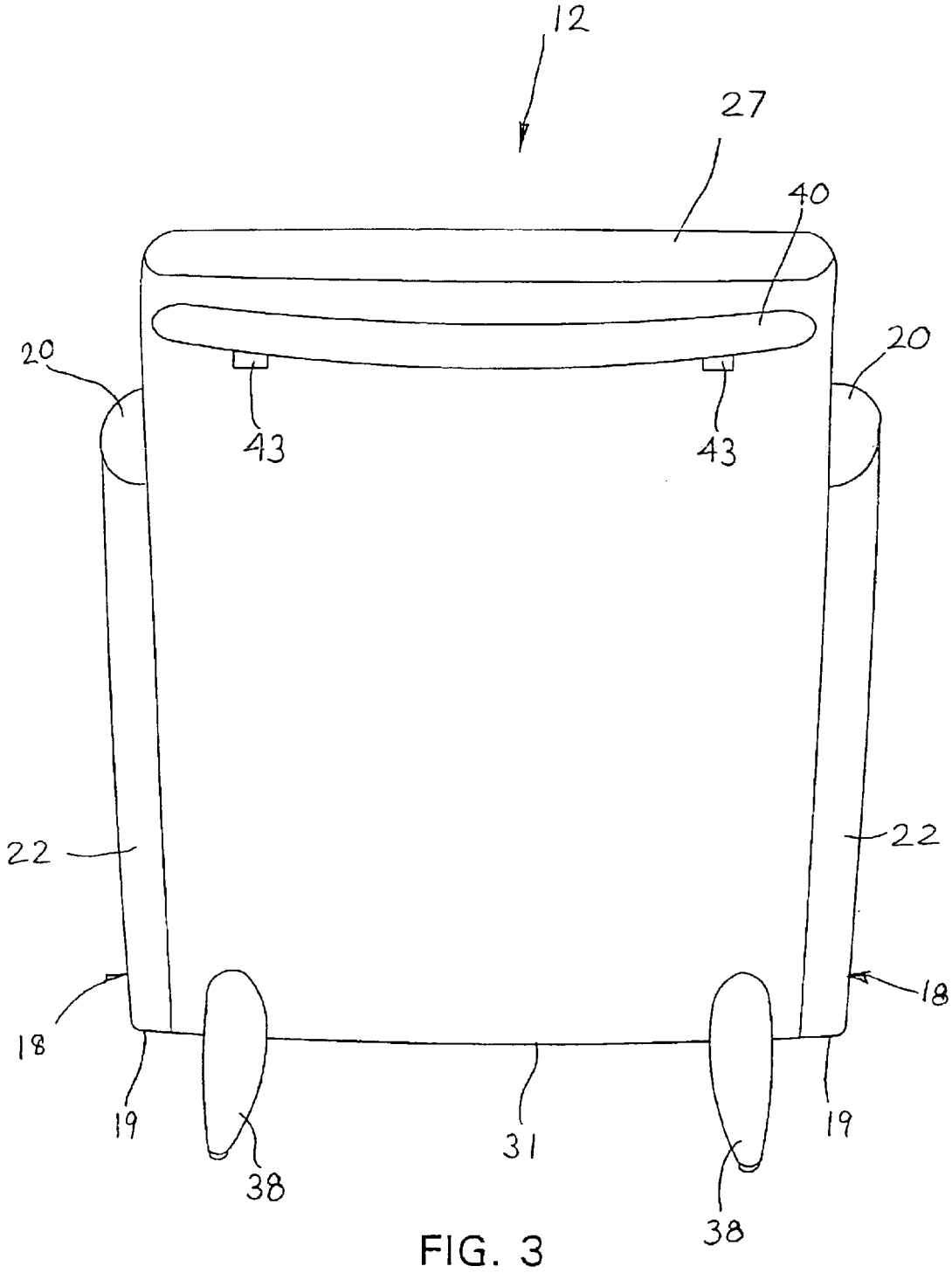
FIG. 3 is a rear view of the chair.

Referring to FIGS. 3 and 5, a generally rectangular back panel 27 is rigidly affixed to the rear edges 22 of the side walls 18. The back panel 27 has an upper cushion section 28 which projects vertically above the upper seat surface 23 and defines a forward facing back surface 29 which is adapted to support the back of a chair user. A lower section of the back panel 27 extends downwardly below the seat 17 and defines a back wall 30. The back wall 30 includes a lower edge 31.

In this chair structure 16, the seat 17 is spaced vertically above a floor or other support surface 32 to effectively define an open storage area or compartment 33. The storage area 33 is enclosed on three sides by lower sections 34 of the side walls 18 as well as the back wall 30. The storage area 33, however, is open on the front side 35 thereof and also opens downwardly towards the floor 32 through a bottom side 36. The storage area 33 thereby serves as a storage bay while the open front side 35 defines an entrance to the storage bay. The storage area 33 is sized so as to receive the mobile cart 14 therein as will be described in further detail.

To support the chair 12 on the floor 32, the chair structure 16 includes a pair of casters or rollers 37 near the lower front corner of each side wall 18. The casters 37 preferably are fixed so as to be non-pivotable and thereby guide movement of the chair in a front/back direction. The casters 37 alternatively could be pivotable about a vertical axis. Additionally, a pair of downwardly projecting support posts or legs 38 are rigidly affixed to the lower edge 31 of the back panel 27. Still further, a handle 40 is affixed to the back panel 27 near the upper edge thereof. The handle 40 bows horizontally outwardly away from the back surface 41 of the back panel 27 to define a space 42 through which the hand of a user may be inserted. The opposite ends of the handle 40 are connected to the back panel 27 by connectors 43.

With the above-described arrangement, the chair 12 is fully mobile yet remains stationary during use without the occurrence of undesirable sliding. In particular, during use, the casters 37 and legs 38 are all in contact with the floor surface 32 wherein the abutting contact between the legs 38 and the floor surface 32 tends to maintain the chair 12 in a stationary position. The chair 12, however, is also readily movable by a chair user grasping the handle 40 to tilt the back end of the chair 12 upwardly to a tilted position as generally indicated by reference arrow 44 in FIG. 6. More particularly, the back end of the chair 12 pivots upwardly about the casters 37 and since the casters 37 define the sole contact with the floor 32, the chair 12 may be readily rolled to any desirable location. Once relocated, the chair user lowers the back end of the chair 12 to the use position of FIG. 5.

Figure 6:
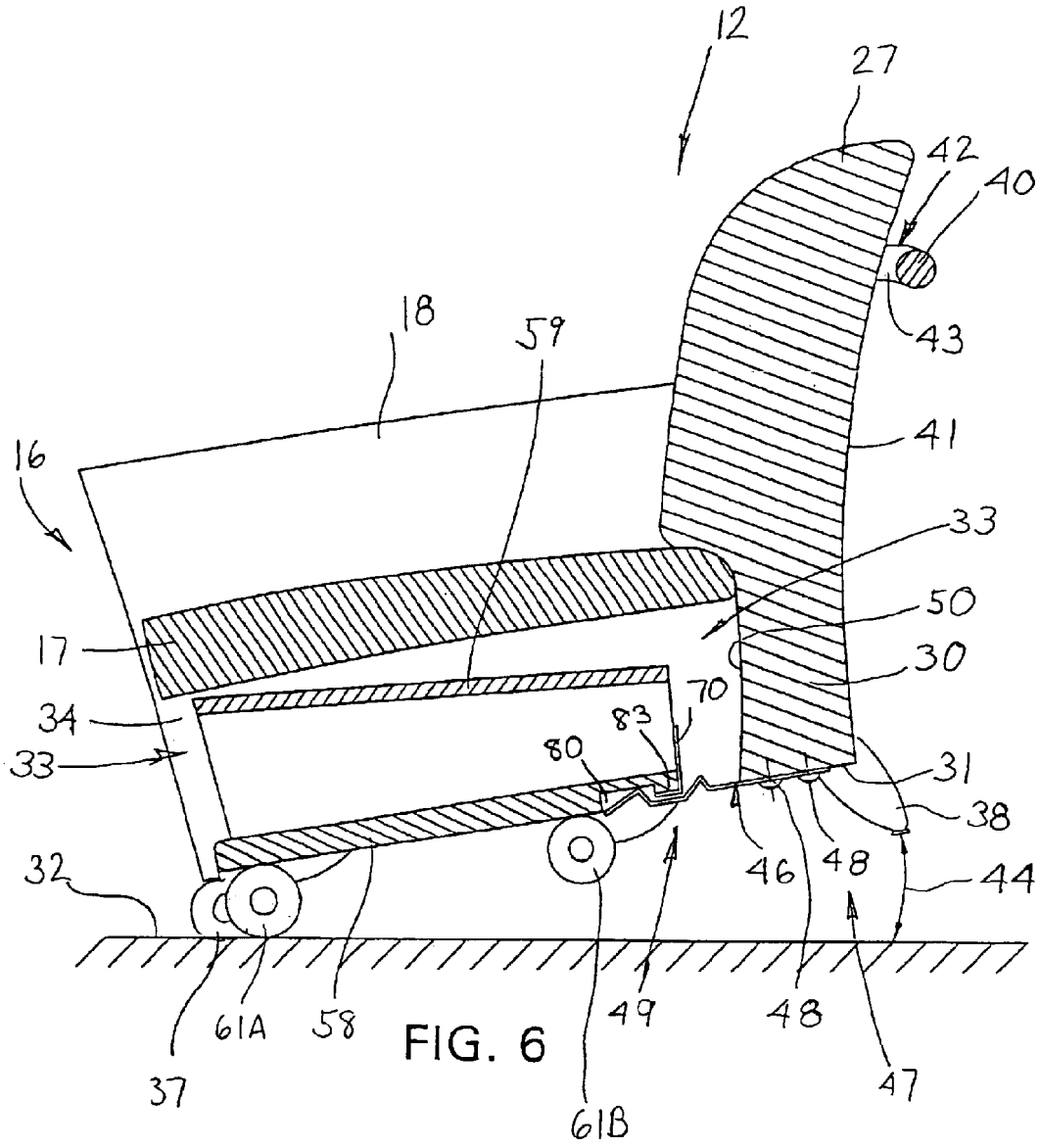
FIG. 6 is a side cross-sectional view of the chair being lifted with the stool in the docked position.

In this inventive seating system 10, the chair 12 not only is adapted to receive the cart 14 within the storage area 33 but also positively engages the cart 14 so that the cart 14 moves in unison with the chair 12 as seen in FIG. 6.

In this regard, the chair structure 16 includes a fastening device preferably formed as a connector bracket 46 which projects into the storage area 33 and is adapted to engage the cart 14. The connector bracket 46 resists separation of the cart 14 from the chair 12 but still permits a user to readily pull the cart 14 horizontally from the storage area 33 when desired. Further, the connector bracket 46 supports the cart 14 vertically as illustrated in FIG. 6 so that the cart 14 tilts upwardly and rolls in unison with the chair 12 during repositioning thereof.

Figure 7:
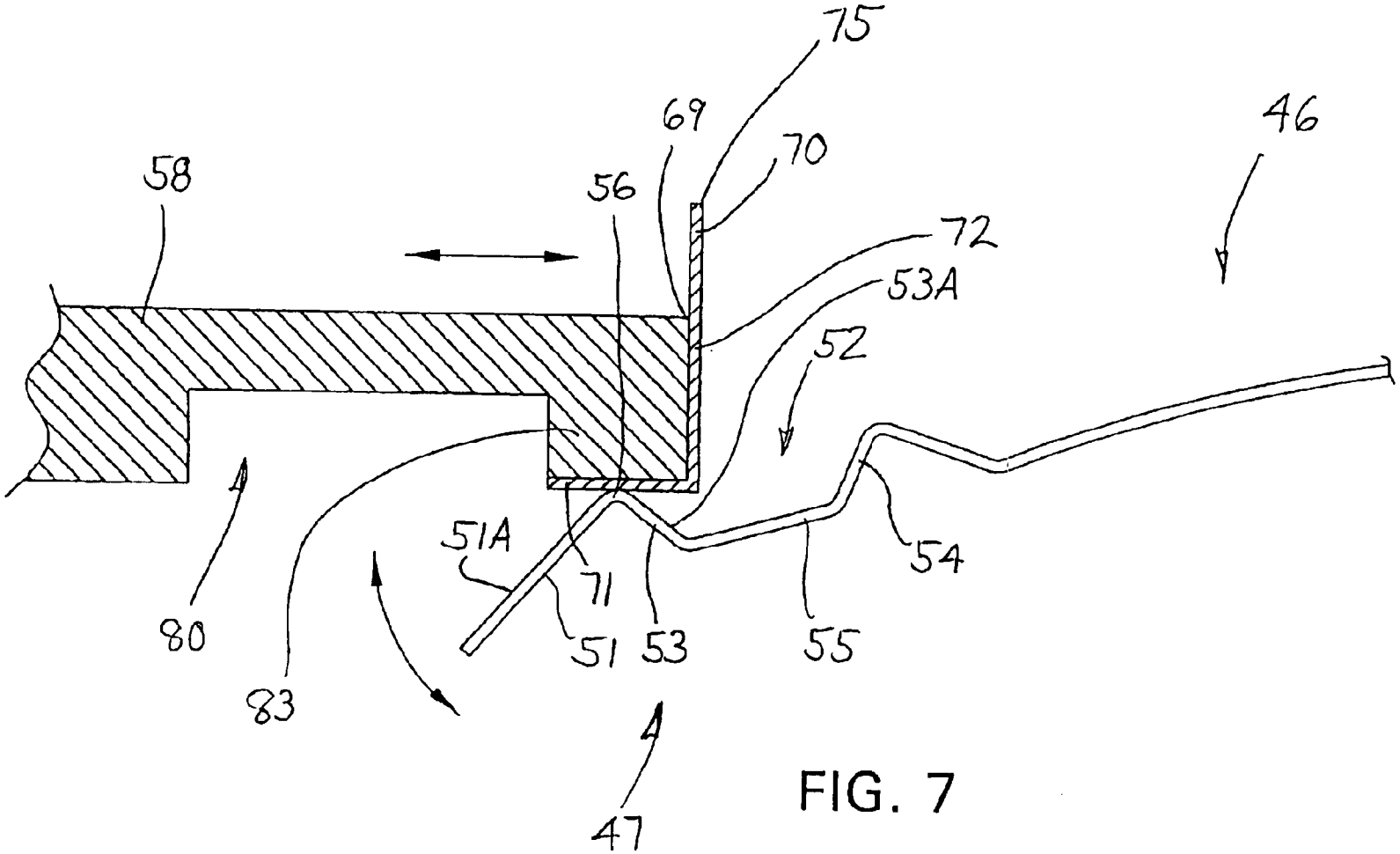
FIG. 7 is an enlarged cross-sectional view of the stool in a partially engaged position with a connector clip of the chair.

The connector bracket 46 is illustrated in further detail in FIG. 7. The bracket 46 includes a mounting section 47 through which a plurality of fasteners 48 are threaded vertically upwardly into engagement with the lower edge 31 of the back panel 27. The connector bracket 46 includes a forward engagement section or catch 49 which projects forwardly from an inside face 50 of the back panel 27 in cantilevered relation. The engagement section 49 generally is adapted to engage the cart 14.

More particularly, the engagement section 49 is formed of bent spring steel, and includes an inclined ramp 51 at the free end thereof which defines a forward facing camming surface 51A. The ramp 51 inclines upwardly in the rearward direction and terminates generally adjacent an upward-opening groove or seat 52. The groove 52 is defined by a declined front wall 53 and an inclined back wall 54 with a bottom wall 55 extending horizontally therebetween. The front wall 53 declines downwardly in the rearward direction and effectively defines a rearward-facing camming surface 53A. As generally illustrated in FIG. 8, the camming surfaces 51A and 53A converge toward an apex 56 and are adapted to effect downward deflection of the engagement section 49 respectively during docking and undocking of the cart 14 within the storage area 33.

Figure 4:
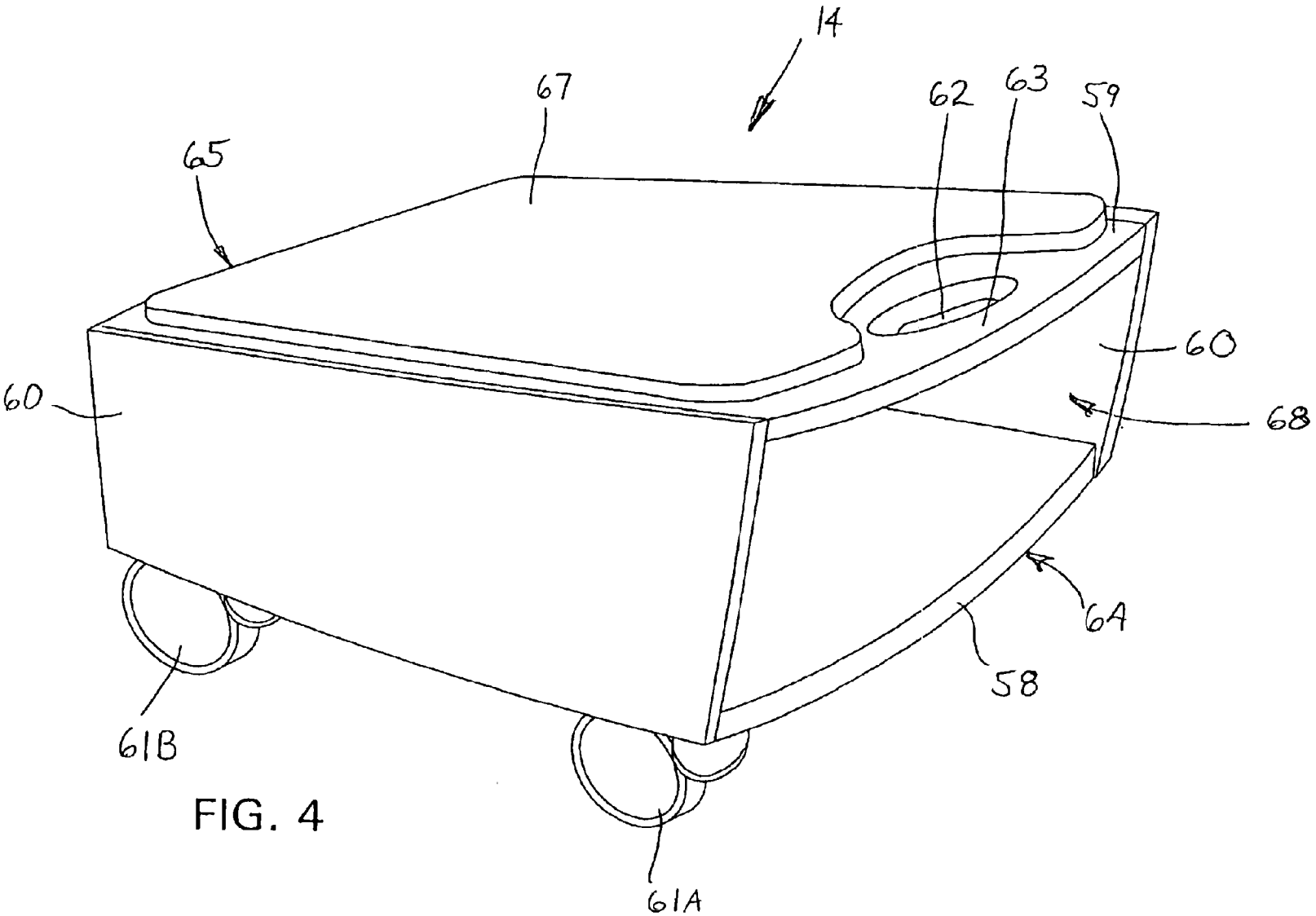
FIG. 4 is a perspective view of the stool.

Referring now to the cart 14, the cart as illustrated in FIG. 4 includes a shelf-like bottom panel 58 and a top panel 59 in vertically spaced relation therewith. The bottom and top panels 58 and 59 are joined together by opposite side walls 60 in a box-like configuration. The bottom panel 58 includes pairs of front casters or rollers 61A and rear casters or rollers 61B respectively near each of the front and rear corners so that the cart 14 is fully mobile and can be readily pushed from one location to another. It will be understood that the arrangement of casters may be varied in the number, location and type of casters and that any other type of support arrangement may be used that provides rolling support to the cart 14.

The top panel 59 includes an oval opening 62 which effectively defines a hand grip or handle 63. The position of the handle 63 thereby defines a front end 64 of the cart 14 while the opposite end defines the back end 65 thereof. The top panel 59 also includes a cushioned pad 67 which either can be adapted for use as a footrest or also as a seating surface. The cart 14 thereby not only is useable as a stool or a footrest but also includes an open interior compartment 68 into which various articles may be stored such that the cart 14 also functions as a storage cart. As such, the term cart broadly encompasses construction and use of the cart as an ottoman, stool, footrest and/or storage caddy or as another mobile vehicle. Further, the cart 14 could be constructed only with the bottom panel 58 and casters 61A and 61B.

Figure 8:
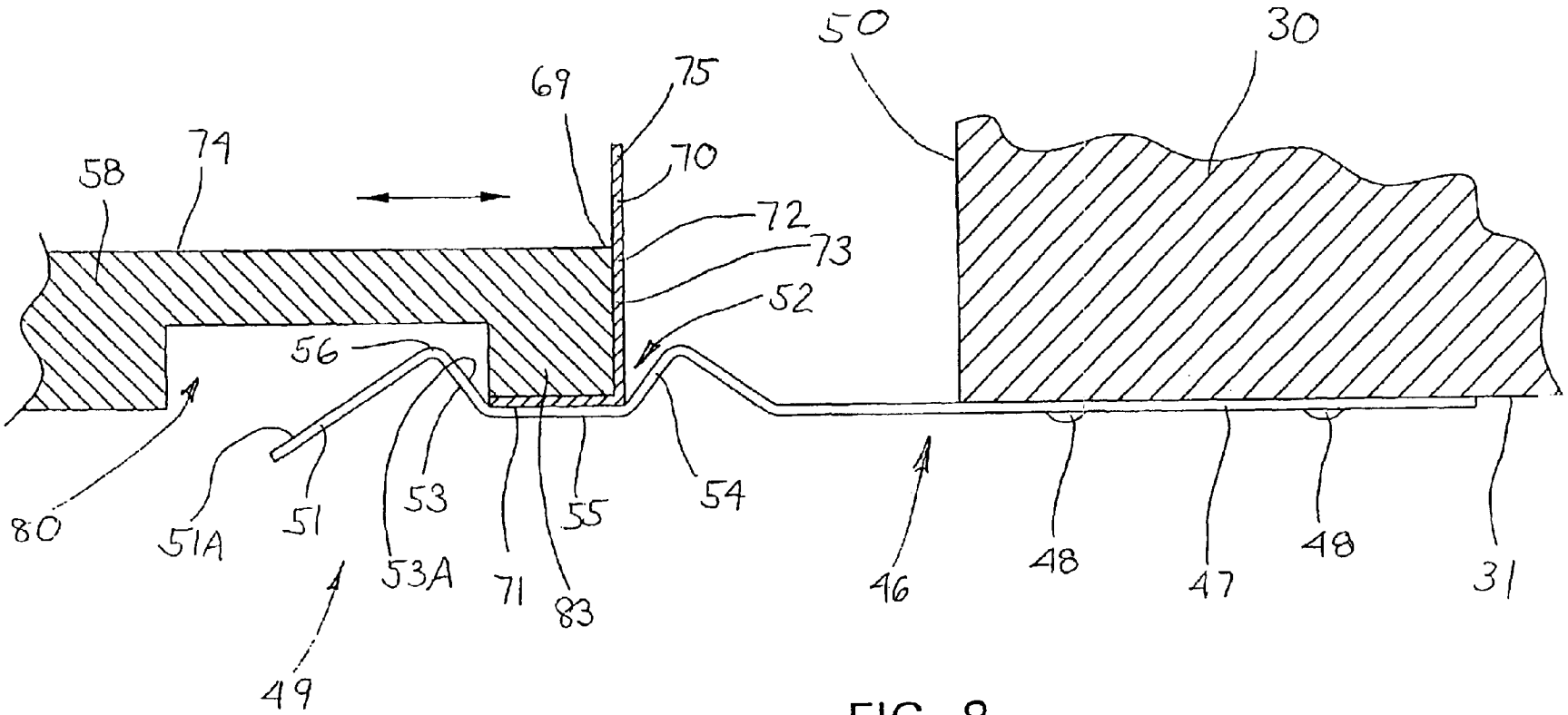
FIG. 8 is an enlarged cross-sectional view of the chair and stool engaged together by the connector clip arrangement.
Figure 9:
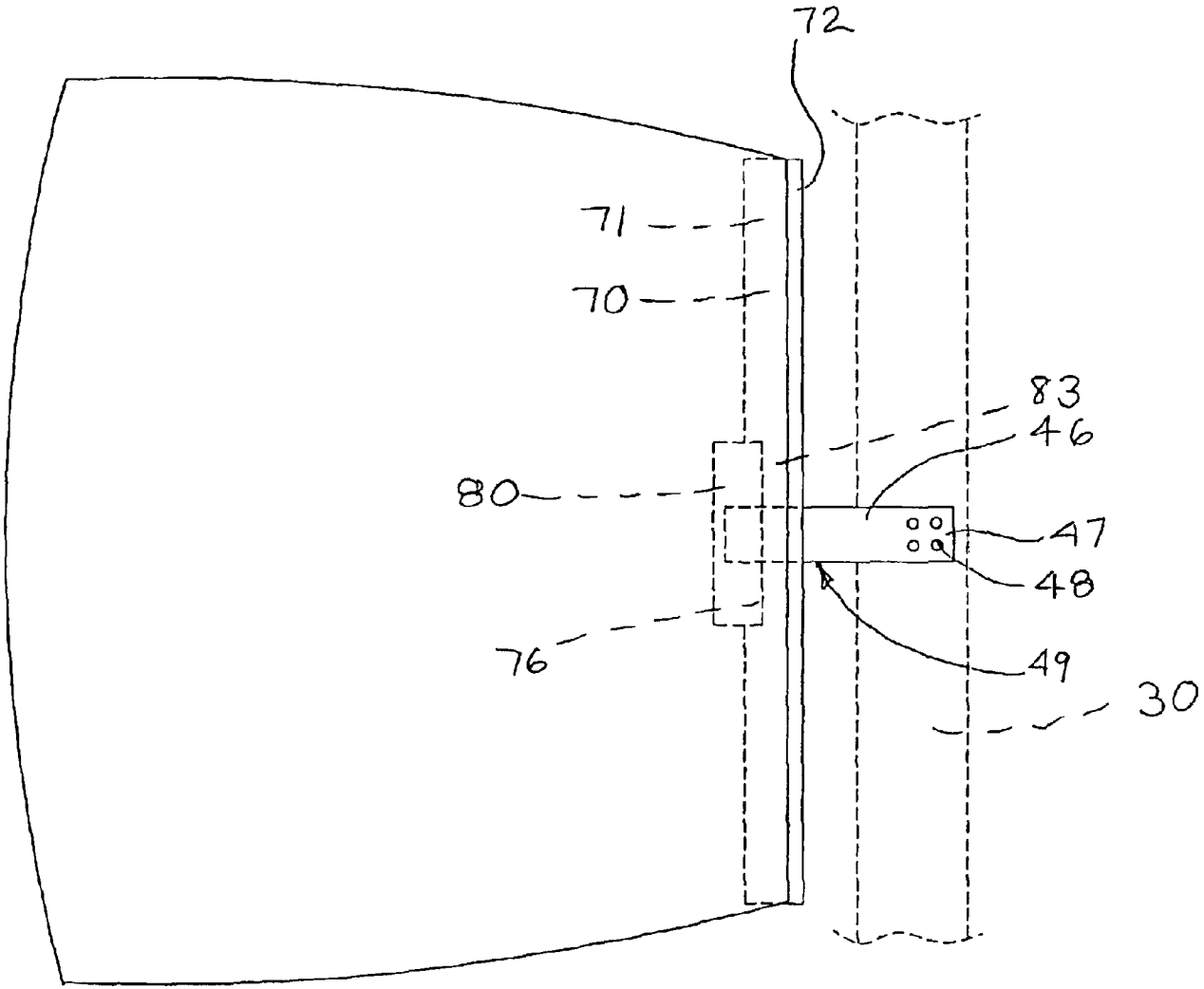
FIG. 9 is a top plan view of the chair and stool engaged together.

Referring more particularly to FIG. 8, the bottom panel 58 terminates at a back edge 69. The back edge 69 is formed with an L-shaped metal bracket 70 which extends horizontally across the length of the rear edge 69 as also seen in FIG. 9. The bracket 70 includes a horizontal leg 71 which abuts against a bottom surface 72 of the bottom panel 58 and receives a plurality of fasteners which are engaged vertically into the bottom panel 58 to secure the bracket 70 in place. The bracket 70 further includes a vertical leg 72 which extends along the back face 73 of the bottom panel 58 and also projects vertically above the top panel surface 74 to define a wall section 75. The wall section 75 effectively serves as a paper catch or stop to prevent stored articles from sliding off the back edge 69 of the bottom panel 58. Additionally, the bracket 70 functions to provide a hard contact surface which eliminates or reduces wear from contact with the connector bracket 43. When viewed from above (FIG. 9), the bracket 70 has a rectangular notched section 76 which is notched into the front edge thereof and is located at the center of the bracket 70.

The bottom panel 58 further includes a rectangular recess 80 which is aligned centrally with and has the same lateral width as the notched section 76 of the bracket 70 as seen in FIG. 9. The panel recess 80 has a width in the front-to-back direction that is approximately twice the horizontal depth of the bracket notch 76. As illustrated in FIG. 7, the recess 80 defines a downward projecting recess wall 83 which is adapted to receive the V-shaped front portion of the connector 43 that is defined by the inclined ramp 51 and the front groove wall 53 as seen in FIG. 8. As the cart 14 is inserted rearwardly into the storage bay 33, the inclined surface 51A of the connector bracket 43 contacts the rear edge bracket 70 and is deflected or cammed downwardly as illustrated in FIG. 8. As the cart 14 is pushed rearwardly by a user, the rear recess wall 83 fits downwardly within the connector groove 52 as the connector bracket 43 restores itself to the undeflected condition illustrated in FIG. 7. Since the back recess wall 83 is fitted within the groove 52, the connector bracket 43 is in positive engagement with the cart 14 to horizontally restrain the cart 14 both in the forward and rearward directions due to the front and back groove walls 53 and 54 and effectively prevent forward and rearward movement of the cart 14 within the storage bay 33. However, the resiliency of the connector bracket 43 still permits a user to grasp the hand grip 63 and pull the cart 14 forwardly from the storage bay 33 with a suitable pulling force. This forward pulling of the cart 14 causes the forward edge of the bracket notch 71 to slide upwardly along the camming surface 53A of the front groove wall 53 and thereby deflect the bracket engagement section 49 downwardly to the same position illustrated in FIG. 8. In this manner, the cart 14 can be docked and undocked from the storage bay 33, and when in the docked position of FIG. 7, the cart 14 is horizontally restrained in combination with the chair 12.

In this regard, referring to FIG. 6, when the rear of the chair 12 is lifted, the connector bracket 43 has sufficient vertical rigidity to cause the back end 65 of the cart 14 to also be raised vertically to a tilted position in unison with the chair 12 wherein the cart 14 pivots about the front casters 61A. As such, the chair 12 is supported solely by its front casters 37 while the cart 14 is supported on the floor 32 solely by its front casters 61A. This allows for the chair 12 and cart 14 to be tilted upwardly and moved across the floor 32 together.

When the chair 12 is lowered to the use position of FIG. 5, the user then can grasp the hand grip 63 to move the cart 14 horizontally outwardly to the undocked position, for example, as illustrated in FIG. 2. With this arrangement, the chair 12 and cart 14 are readily useable separately but also may be positively engaged with each other and move together in unison which greatly simplifies use of the seating system 10.

It will be understood that the same fastening arrangement could be provided with the parts reversed where the connector bracket 43 could be provided on and project rearwardly from the cart 14. The chair 12 could be provided with a recess 80 and a downwardly projecting flange formed like the rear recess wall 83.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A seating system comprising:

a chair having a support structure on which a seat is supported, said support structure including casters near a front end thereof and a back thereof adapted to be supported on a floor when said chair is in a use position, said back of said chair being liftable upwardly from said use position to a tilted position wherein said chair is supported on said casters and is repositionable by said casters rolling along said floor, said chair including a storage bay below said seat which is open on a bottom thereof toward said floor and is open on one side thereof to define an entrance to said storage bay;

a mobile cart which fits within said storage bay and has casters wherein said cart is supported on said floor by said casters and is repositionable by said casters rolling along said floor, said cart having said casters at least on a front end thereof and said cart being insertable into said storage bay through said entrance; and a fastening device being provided within said storage bay which positively engages said cart with said chair when said cart is inserted within said storage bay in a docked position, said fastening device providing a connection between said chair and said cart such that said fastening device restrains forward movement of said cart within said storage bay and supports said back end of said cart vertically to tilt upwardly with said chair as said chair is lifted to said tilted position wherein said chair and said cart are supported on the respective front ends thereof by said respective casters disposed thereon, said cart being disengageable from said fastening device by manual pulling of said cart out of said storage bay, said fastening device comprising a resiliently deflectable bracket which projects into said storage bay, said bracket including an inclined front surface which is adapted to contact an edge of said cart and deflect said bracket downwardly upon movement of said cart into said storage bay toward said bracket.

2. The seating system according to claim 1, wherein said bracket includes a groove disposed inwardly of said inclined surface, said cart including a catch projecting downwardly therefrom which is positioned to contact said inclined surface and deflect said bracket downwardly and to be received within said groove upon further rearward movement of said cart.

3. A seating system comprising:

a chair having a support structure which includes a seat supported thereon and a roller arrangement such that a front end of said chair is supported in rolling engagement with a floor, said support structure including a gripping section for lifting of a back end of said chair upwardly from a use position, wherein said front and back ends are supported on the floor, to a tilted position, wherein said front end is disposed in said rolling engagement with said floor, said chair including a storage bay below said seat which is open on a bottom thereof toward said floor and is open on one side thereof to define an entrance to said storage bay;

a mobile cart which fits within said storage bay and has a roller arrangement wherein said cart is supported in rolling engagement with said floor, said cart being insertable into said storage bay through said entrance; and said seating system further including a fastening arrangement comprising cooperating fastening parts on said chair and said cart which are engageable one with the other upon insertion of said cart within said storage bay to a docked position, said cooperating fastening parts defining a releasable connection between said chair and said cart when in said docked position which said connection restrains movement of said cart out of said storage bay and vertically supports a back end of said cart such that said cart tilts upwardly with said chair as said chair is lifted to said tilted position wherein respective front ends of said chair and said cart are disposed in rolling engagement with the floor, said cooperating fastening parts being disengageable by pulling of said cart out of said storage bay, one of said cooperating fastening parts comprising a connector bracket which is engageable with the other of said fastening parts through horizontal rearward movement of said cart into said storage bay, said connector bracket being resiliently deflectable to horizontally restrain movement of said cart while permitting horizontal separation of said cart from said storage bay and having a rigidity which provides vertical support to said cart during tilting of said chair, said connector bracket including an inclined front surface which is adapted to contact the other of said fastening parts and is thereby deflected downwardly upon movement of said cart into said storage bay.

4. The seating system according to claim 3, wherein said bracket includes a groove disposed rearwardly of said inclined surface which is adapted to receive the other of said fastening parts wherein said groove includes at least a front side wall which restrains forward movement of said cart.

5. The seating system according to claim 4, wherein said front wall of said groove is inclined in a forward direction such that pulling of said cart from said storage bay causes downward deflection of said bracket to permit disengagement of said cooperating fastening parts.

6. A seating system comprising:

a chair including a support structure having a seat and opposite ends which are supported on a floor when said chair is in a use position, one of said ends of said support structure being liftable upwardly from said use position to a tilted position, wherein the other of said ends remains supported on said floor, said chair including a storage bay below said seat;

a mobile cart which fits within said storage bay and has a roller arrangement wherein said cart is supported in rolling engagement with said floor, said cart being insertable into said storage bay through one side thereof; and said seating system further including a fastening arrangement comprising cooperating fastening parts on said chair and said cart which are engageable one with the other in response to insertion of said cart within said storage bay to a docked position and are disengageable in response to manual pulling of said cart out of said storage bay to an undocked position, said cooperating fastening parts restrain said cart to prevent removal of said cart from said storage bay in the absence of manual pulling of said cart, said fastening part on said chair projecting into said storage bay and said cooperating fastening part on said cart being slidable onto said projection such that said projection vertically supports an inner end of said cart and said cart thereby is tiltable in unison with said chair during tilting of said chair to said tilted position, said cart during tilting thereof having a raised end and an opposite lower end which is disposed in rolling engagement with the floor, and said chair and said cart when in said tilted position being movable together across the floor wherein said storage bay opens through the end of said chair opposite to said lifted end such that said cart is prevented from being slid out of said storage bay during movement of said chair and said cart, said projecting fastening part on said chair being a spring clip which is resiliently deflectable downwardly during engagement and disengagement of said cart therewith.

7. A seating system comprising:

a chair including a support structure having a seat and opposite ends which are supported on a floor when said chair is in a use position, said support structure including a gripping section for lifting one of said ends upwardly from said use position to a tilted position, wherein the other of said ends remains supported on said floor, said chair including a storage bay below said seat;

a mobile cart which fits within said storage bay and has a roller arrangement wherein said cart is supported in rolling engagement with said floor, said cart being insertable into said storage bay through one side thereof; and said seating system further including a fastening arrangement comprising cooperating fastening parts on said chair and said cart which are engageable one with the other in response to insertion of said cart within said storage bay to a docked position and are disengageable in response to manual pulling of said cart out of said storage bay to an undocked position, said fastening part on said chair projecting into said storage bay and said cooperating fastening part on said cart being slidable onto said projection such that said projection vertically supports an inner end of said cart and said cart thereby is tiltable in unison with said chair during tilting of said chair to said tilted position, said cart during tilting thereof having a raised end and an opposite lower end which is disposed in rolling engagement with the floor, said projecting fastening part on said chair being a spring clip which is resiliently deflectable downwardly during engagement and disengagement of said cart therewith.

8. The seating system according to claim 7, wherein said spring clip includes an upward opening groove which receives an edge of said cart to restrain said cart relative to said chair.

9. The seating system according to claim 8, wherein said spring clip includes opposite inclined surfaces which respectively deflect said spring clip downwardly during engagement and disengagement of said cart.

10. A seating system comprising:

a chair having a support structure on which a seat is supported and having a storage bay below said seat which is open on a bottom thereof toward said floor and is open on one side thereof to define an entrance to said storage bay;

a mobile cart which is displaceable along a floor by manual movement thereof and is insertable into said storage bay through said entrance, said cart being supported on the floor when in said storage bay and having an inner edge which is disposed within said storage bay when said cart is inserted therein; and a fastening device on said chair which projects into and is enclosed within said storage bay to positively engage said cart with said chair when said cart is fully inserted within said storage bay in a docked position, said fastening device providing a connection between said chair and said cart such that said fastening device restrains movement of said cart out of said storage bay wherein said cart is held in said docked position during manual movement of said chair so that said chair and said cart move in unison, said cart being disengageable from said fastening device by manual pulling of said cart out of said storage bay, said fastening device being resiliently movable and including a front surface which is adapted to contact said inner edge of said cart and move said fastening device downwardly upon movement of said cart into said storage bay.

11. The seating system according to claim 10, wherein said support structure of said chair includes a support member on a back side of said storage bay which includes said fastening device thereon, said fastening device projecting forwardly into said storage bay and being engaged with said cart upon rearward movement of said cart into said storage bay to said docked position.

12. The seating system according to claim 11, wherein said front surface of said fastening device is inclined and said fastening device includes a groove disposed inwardly of said inclined surface, said cart including a catch projecting downwardly adjacent said inner edge wherein said catch is positioned to contact said inclined surface and deflect said fastening device downwardly, said catch being received within said groove upon positioning of said cart in said docked position.

13. A seating system comprising:

a mobile seat having a frame structure supported on a floor and an upward facing seat surface for supporting an occupant thereon in a seated position, said frame structure defining a storage area adjacent to the floor, and said storage area including an open side which opens sidewardly and defines an entrance thereto;

a mobile cart having a cart frame supported on a floor and an upward facing support surface, said cart being separate from said seat and movable independently of said seat for use exteriorly adjacent to said seat, said cart being movable along the floor and being sized to fit within said storage area through said open side, said cart being positionable in a docked position within said storage area so as to permit removable fastening of said cart to said seat for movement of said seat and cart in unison along the floor; and a fastening device provided within said storage area which releasably fastens said cart and said seat together when said cart is in said docked position such that manual repositioning of said seat along the floor causes said cart to move in unison with said seat, said fastening device restraining movement of said cart away from said docked position toward said open side while permitting unfastening of said cart from said seat in response to manual pulling of said cart away from said docked position through said open side, said fastening device comprising a resiliently deflectable bracket which projects into said storage area and is deflectable in a release direction, said bracket including an inclined front surface which is adapted to contact an edge of said cart and deflect said bracket in said release direction upon inward movement of said cart toward said bracket to said docked position wherein said bracket fastens said cart to said seat, said bracket further having an inclined rear surface adjacent said front surface wherein said rear surface cooperates with said edge of said cart to deflect said bracket in said release direction upon outward movement of said cart away from said docked position.

* * * * *